United States Patent [19]

Mazzocco et al.

[11] Patent Number: 4,674,747

[45] Date of Patent: Jun. 23, 1987

[54] GOLF CLUB HAVING ADJUSTABLE LENGTH SHAFT

[75] Inventors: Thomas R. Mazzocco, Granada Hills; Michael H. Frenchik, Jr., Canoga Park, both of Calif.

[73] Assignee: Teleshaft Company, Inc., Canoga Park, Calif.

[21] Appl. No.: 766,121

[22] Filed: Aug. 14, 1985

[51] Int. Cl.[4] ..... A63B 53/16

[52] U.S. Cl. ..... 273/81.2; 206/315.6; 206/315.5; 273/162 F; 273/80 D

[58] Field of Search ..... 273/81.2, 77 A, 80 D, 273/162 F, 162 R

[56] References Cited

U.S. PATENT DOCUMENTS 3,528,660 9/1970 Kategian ..... 273/81.2 X

*Primary Examiner*—George J. Marlo

*Attorney, Agent, or Firm*—Frank Frisenda, Jr.

[57] ABSTRACT

The present invention provides an improved golf club having an adjustable length shaft retractable between fully extended and collapsed positions. In one embodied form, the inventive golf club comprises plural concentric telescopic interlocking tubular sections which produce a friction lock between the tubular sections in a fully extended position. When the inventive club is in a fully collapsed position, the proximate ends of the tubular sections are disposed in relation to one another in sufficient distance to permit grasp of a player's hand about one of the tubular sections, but without the occurrence of pinch between proximate ends of the tubular sections. In another embodiment of the invention, a durable lightweight golf bag is provided which provides a convenient means for carrying the inventive golf clubs and associated golfing equipment. Accordingly, the present invention provides improved golf clubs which are more conveniently retracted in a collapsed position without required specialized tools and which minimize the occurrence of pinch of a player's hand when the club is in a retracted position.

5 Claims, 6 Drawing Figures

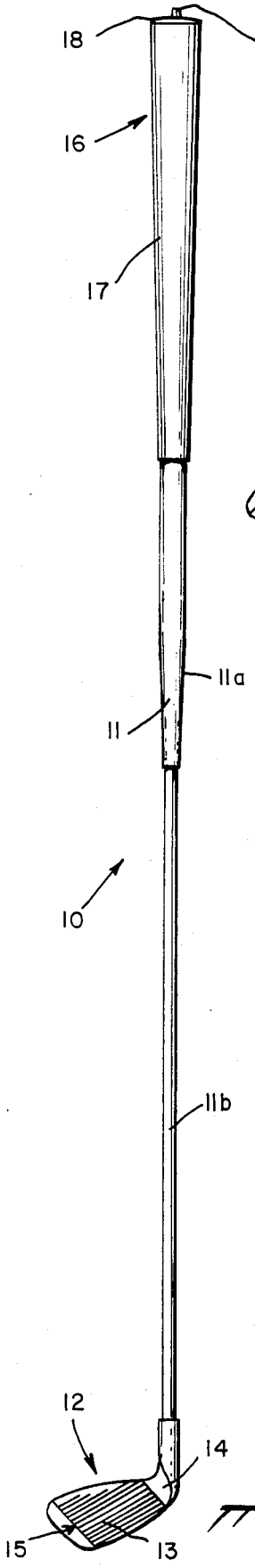
Fig. 1.
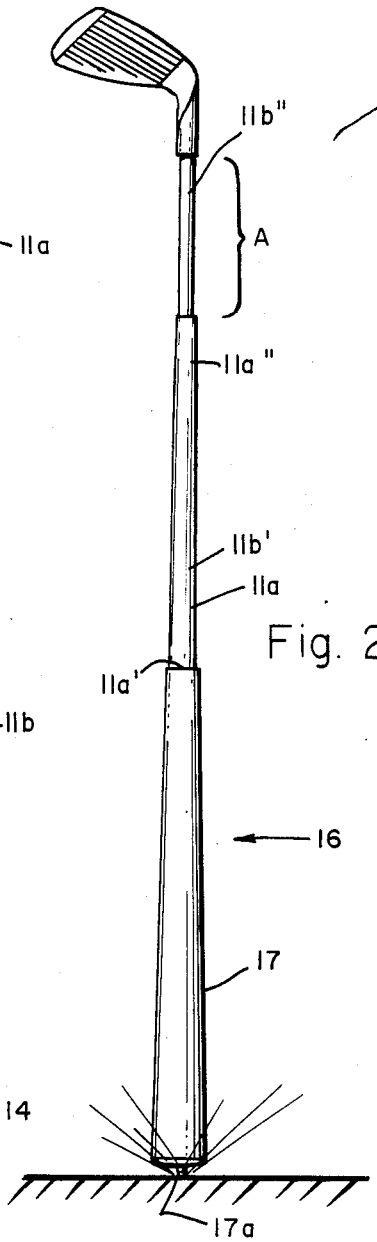
Fig. 2.
Fig. 3.
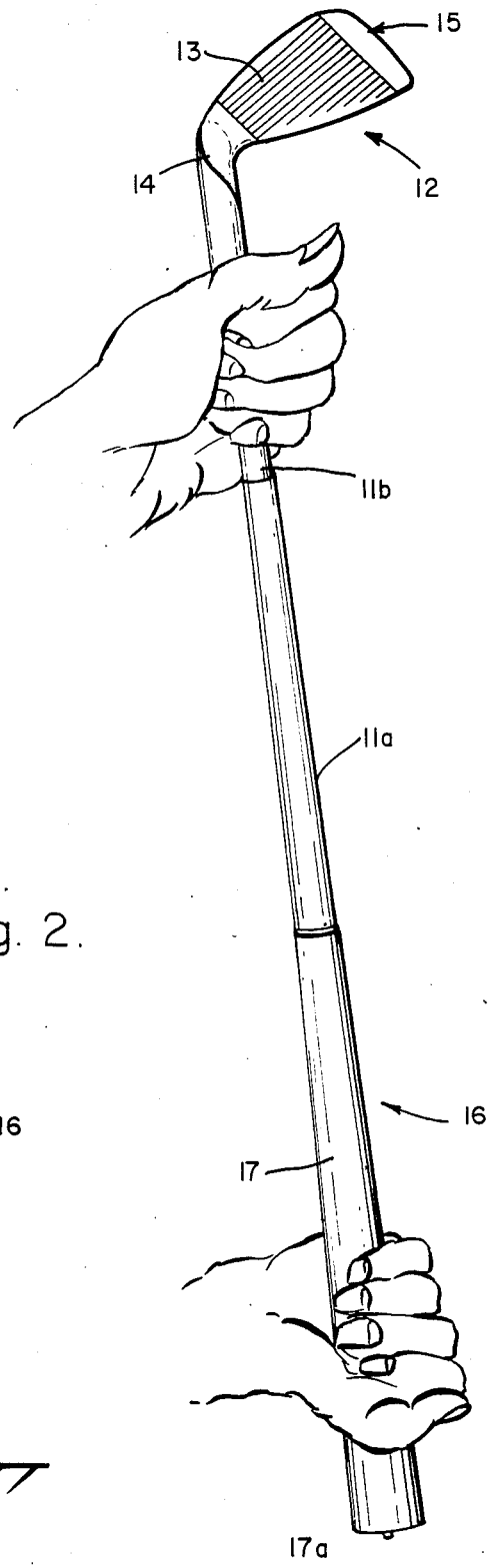

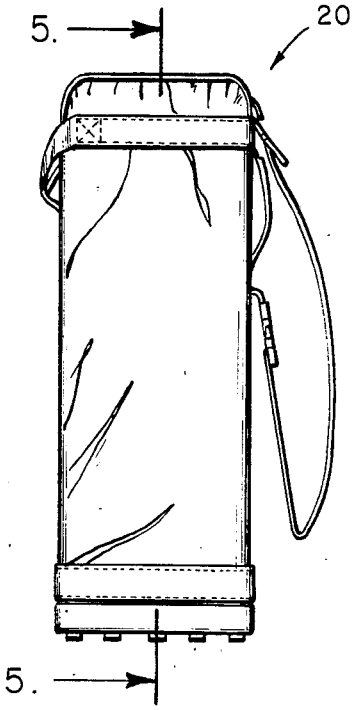
Fig. 4.
Fig. 5.
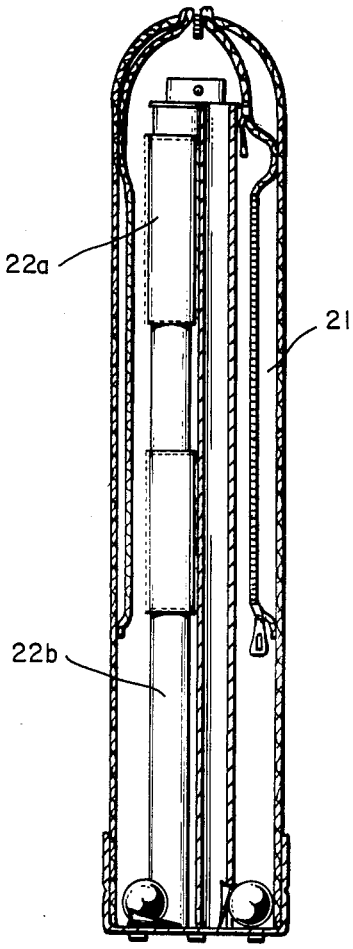
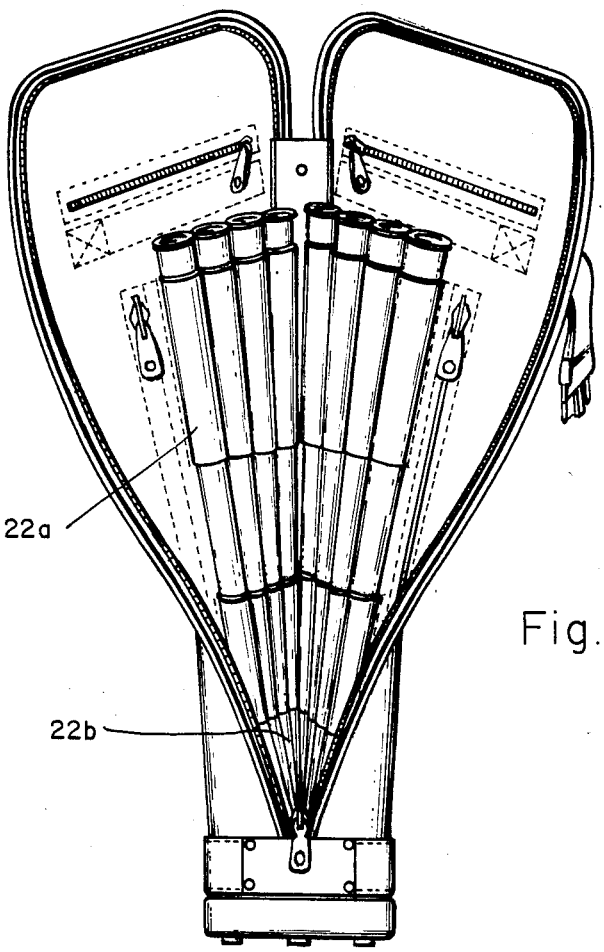
Fig. 6.

GOLF CLUB HAVING ADJUSTABLE LENGTH SHAFT

BACKGROUND OF THE INVENTION

This invention relates to improvement in the art of golf clubs and golf bags, and more particularly, to golf clubs having an adjustable length shaft retractable between fully extended and collapsed positions.

The sport of golfing has enjoyed avid acceptance in the United States and throughout the world for numerous decades.

For at least the last two decades, a number of skilled artisans have sought to make playing equipment more convenient and less bulky for the player. In this regard, one such improvement has been the development of golf clubs having an adjustable length shaft retractable between fully extended and collapsed positions.

Andia in U.S. Pat. No. 3,539,185, discloses a golf club having a shaft which is adjustable in length and which can be tightly locked at the desired length by an internal wedge which prevents inadvertent twisting of the grip relative to the rest of the shaft.

The patent to Kategian (U.S. Pat. No. 3,528,660), relates to a golf club having an axially collapsible shaft comprising a plurality of telescoping tubular sections, which, in fully extended positions, are secured and frictionally held against rotation relative to each other. The golf club sections are releaseably held in a collapsed position by a bayonet slot connection or by a frictional fit between the inside of the outer section and the outside of the ferrule fixed on the neck portion of the golf club in one embodied form of the Kategian invention.

Warnock in U.S. Pat. No. 3,214,170, discloses an adjustable golf club comprising a head having a recess bounded by arcuate surfaces. One stated object of the Warnock invention is to provide an improved club assemblage wherein both the angularity of the head relative to the shaft and the length of the shaft may be conveniently varied to accommodate diverse requirements, and in which the parts can be locked in adjusted positions so as to insure maintenance of the adjustment, as well as to meet tournament rules.

Other golf clubs having collapsible features are disclosed in U.S. Pat. Nos. 3,840,231; 3,829,092; 3,663,019; 3,524,646; 3,102,726; 3,070,370; 2,214,079; and 2,107,983.

While realizing the advantages inherent in a collapsible club, a number of prior devices have had relatively complex interlocking mechanism, and/or suffered drawbacks from a player's standpoint associated with the occurrence of "crimping" or "pinching" of the skin of a player's hand when the telescopic shaft of a golf club was retracted into a collapsed position. Further, a number of prior devices of the frictional locking type were difficult to disengage one tubular section from another, often necessitating the impacting of the grip member of the club against for instance, a concrete surface to cause disengagement of the tubular sections of the golf club shaft.

Those skilled in the art, therefore, have recognized a significant need for an improved golf club which is more conveniently retracted in a collapsed position without required specialized tools and which minimizes the occurrence of "pinch" of a player's hand when the club is in a retracted position. The present invention fulfills these needs.

SUMMARY OF THE INVENTION

The present invention provides a golf club having an adjustable length shaft retractable between fully extended and collapsed positions. Briefly, and in general terms, the inventive golf club comprises a club head having a ball engaging surface, a rear face, a heel portion, and a toe portion; an intermediate axially collapsible shaft comprising plural concentric telescopic interlocking tubular sections; and a handle element comprising a grip member disposed on an upper portion of the collapsible shaft.

In more detail, the improved golf club in accordance with the present invention comprises concentric telescopic interlocking tubular sections having a first female cylindrical section, including a distal end and a proximate end which cooperates with a second male cylindrical section having a distal end and a proximate end to provide a friction lock when said tubular shaft is in a fully extended position.

When the inventive club is in a fully collapsed position, the proximate ends of the tubular sections are disposed in relation to one another in sufficient distance to permit grasp of a player's hand about one of the tubular sections, but without the occurrence of pinch between proximate ends of the tubular sections of the collapsible shaft.

In another embodiment of the invention, rigid projection means is provided on the distal end of the handle element and has sufficient height and sufficient hardness to protect the grip member of the handle from abrasion when, for instance, the handle element is impacted on the ground by a player to facilitate disengagement of the friction lock between the tubular sections of the shaft. The features of the present invention may be incorporated into a full set of golf clubs, including irons and clubs having wooden heads. Preferably, each of the clubs in a fully extended position will have an overall length within a conventional range, that is, up to about 43 inches in length, and when retracted into a fully collapsed position, will have an overall length of 27 inches or less.

In another embodiment of the invention, a durable, lightweight golf bag is provided which is a convenient means for carrying the inventive golf clubs and associated golfing equipment. Preferably, the golf bag is constructed of nylon material and has an overall length of about 26 inches to permit the golf club bag to be boarded as carry-on luggage in aircrafts.

Accordingly, the present invention provides golfing equipment suitable for tournament play, which is less bulky and more convenient to use for the player who desires adjustable length golf clubs retractable between fully extended and collapsed positions.

BRIEF DESCRIPTION OF THE DRAWINGS

FIG. 1 is a perspective view of the inventive golf club, in one embodied form, illustrated as having an adjustable length shaft in a fully extended position;

FIG. 2 is the inventive golf club shown in FIG. 1 illustrated with the adjustable length shaft having a fully collapsed position;

FIG. 3 is a perspective view of the inventive golf club shown in FIG. 1 illustrating the inventive club being retracted from a fully extended to a collapsed position and illustrating the grasp of a player's hand about one of the tubular sections of the shaft;

FIG. 4 is a side elevational view of one embodied form of an inventive golf bag which provides a convenient means for carrying the inventive golf clubs and associated golfing equipment of the present invention;

FIG. 5 is a cross-sectional view of the inventive golf club bag shown in FIG. 4 taken substantially along the line 5—5 and depicting the internal structure of the inventive golf club bag in accordance with one embodied form of the present invention; and FIG. 6 is a perspective view of the inventive golf club bag shown in FIG. 4 in an open position illustrating a set of inventive golf clubs in a fully collapsed position and internal components of the inventive golf club bag in accordance with one embodied form of the present invention.

DETAILED DESCRIPTION OF THE PREFERRED EMBODIMENTS

The present invention provides an improved golf club having an adjustable length shaft retractable between fully extended and collapsed positions. In one embodied form, the inventive golf club comprises plural concentric telescoping interlocking tubular sections which produce a friction lock between the tubular sections in a fully extended position. When the inventive club is in a fully collapsed position, the proximate ends of the tube sections are disposed in relation to one another in sufficient distance to permit grasp of a player's hand about one of the tubular sections, but without the occurrence of pinch between proximate ends of the tubular section. In another embodiment of the invention, a durable lightweight golf bag is provided as a convenient means for carrying the inventive golf clubs and associated golfing equipment. Accordingly, the present invention provides improved golf clubs which are more conveniently retracted in a collapsed position without required specialized tools and which minimize the occurrence of pinch of a player's hand when the club is in a retracted position.

Referring now to the drawings, there is shown in FIG. 1 one embodied golf club, generally denoted 10, having an adjustable length shaft 11 retractable between fully extended (FIG. 1) and fully collapsed (FIG. 2) positions.

In more detail, the embodied inventive golf club 10 as shown in FIG. 1, comprises a club head, generally denoted 12, having a ball engaging surface 13, a rear face (not shown), a heel portion 14, and a toe portion 15.

The adjustable length shaft 11 comprises plural concentric telescopic tubular sections, 11*a* and 11*b*, and a handle element, generally denoted 16, comprising a grip member 17 disposed on an upper portion of the collapsible shaft 11.

As shown most clearly in FIGS. 1 and 2, projection means 17*a* is provided on the distal end of the handle element 16. The projection means 17*a* is of sufficient height and sufficient hardness to protect the grip member 17 of the handle element 16 from abrasion when, for instance, the handle element 16 is impacted on the ground by a player to facilitate disengagement of the friction lock between tubular sections 11*a* and 11*b* of the shaft 11 when the club is brought into a fully collapsed position as shown in FIG. 2.

Preferably, the projection means 17 is fabricated from steel carbide and imbedded within an aluminum plug provided on the distal end of the handle element 16.

By providing solid metallic continuity this projection means 17*a* facilitates disengagement of the telescoping sections 11*a* and 11*b* when striking on the ground. Accordingly, the deleterious cushioning, abrasion and/or destruction of the rubber, composition and leather grip member on the distal end of the handle element is minimized. This prevents the shaft from sticking in an extended position, a common problem associated with conventional telescopic golf club shafts.

As further shown in FIG. 2, the improved golf club 10 in accordance with the present invention, comprises interlocking tubular sections having a first female cylindrical section 11*a*, including a distal end 11*a* prime and a proximate end 11*a* double prime. The female cylindrical section 11*a* cooperates and is concentric about a second male cylindrical section 11*b* having a distal end 11*b* prime and a proximate end 11*b* double prime. As previously described, the concentric telescopic interlocking tubular sections 11*a* and 11*b* provide a friction lock when the tubular shaft 11 is in a fully extended position.

FIG. 3 is a perspective view of the inventive golf club 10 being retracted by a player from a fully extended position as shown in FIG. 1 to a fully collapsed position as shown in FIG. 2.

Typically, a player will grasp the inventive club with one hand on the grip member 17 and one hand on the male tubular section 11*b* in the region A shown in FIG. 2. Preferable region A will range from about 2" to about 6" in length.

When the proximate ends 11*a*" and 11*b*" of the shaft 11 and the club head 12 are grasped by the player's hand the distal projection 17*a* may be struck on a hard surface (FIG. 2) to collapse the shaft 11 and the occurrence of pinch is avoided by the distance A between 11*a*" and 11*b*", while the projection means 17*a* protects the grip member 17 from damage while striking the hard surface.

It is therefore an important feature of the present invention, that the proximate ends 11*a*" and 11*b*" of the tubular sections 11*a* and 11*b* are disposed in relation to one another in sufficient distance A to permit grasp of a player's hand about the male tubular section 11*b*, without the occurrence of pinch between proximate ends 11*a*" and 11*b*" of the tubular sections 11*a* and 11*b*.

In another embodiment of the invention, a durable light-weight golf bag generally denoted 20 is depicted in FIG. 4. The golf bag 20 provides a convenient means for carrying the inventive golf clubs, including woods and irons, and associated golfing equipment, such as golf balls, golf tees, golf shoes and the like.

As shown more clearly in FIG. 5, the golf bag 20 comprises internal zippered pockets 21 and a plurality of upper collar elements 22*a* and lower collar elements 22*b*. The internal collar elements 22*a* and 22*b* are sized to permit easy insertion of golf club shafts therein. Typically, the golf clubs are inserted into the collar elements with projection means 17*a* positioned in the lower portion of the golf bag 20. The collar members 22*b* provided in the lower portion of the golf bag 20 extend throughout the lower portion of the golf bag 20 and sewn to the bottom surface of the bag 20*b*. This arrangement insures that golf shafts will be easily inserted into the collar members 22 without resistance from loose golf tees and/or other equipment which can be conveniently kept in the golf bag portion 20*b*.

FIG. 6 depicts the inventive golf bag 20 in an open position, further illustrating zippered pockets 21 and golf clubs (heads not shown) inserted into the collar members 22*a* and 22*b*.

Accordingly, the improved golf clubs of the present invention possess the advantages inherent in a collapsible club but without relatively complex interlocking mechanisms. Perhaps, more importantly, the golf clubs of the present invention, from a player's standpoint, minimize the occurrence of "crimping" or "pinching" of the skin of a player's hand when the telescopic shaft of a golf club is retracted into a collapsed position. Further, the present invention protects the delicate material of the grip member of the handle element by providing increased strength and protection of the distal end of the handle element, when for instance, a player impacts the grip member against a concrete surface to facilitate disengagement of the tubular sections of the golf club shaft, and in addition providing a solid metal train to transmit force from hard surface to shaft, facilitating disengagement maneuver and preventing sticking in the extended position.

The inventive golf bag is sized with an overall length of preferably no more than 26 inches to facilitate the golf bag to be boarded as carry-on luggage in aircraft.

With these features, a player may conveniently carry and use the inventive golf clubs and transport them, for instance, to numerous tournaments throughout the country.

Those skilled in the art will readily appreciate that various modifications made to the specific embodiments disclosed herein. It is not intended that the invention be limited, except by the appended claims.

We claim:

1. In a golf club having an adjustable length shaft retractable between fully extended and collapsed positions, said golf club comprising a club head having a club head hozel, a ball engaging surface, a rear face, a heel portion, and a toe portion; an intermediate axially collapsible shaft comprising plural concentric telescopic interlocking tubular sections; and a handle section comprising a grip member disposed on an upper portion of said collapsible shaft, the improvement consisting of:

providing said concentric telescopic interlocking tubular sections as a first female cylindrical section and as a second male cylindrical section; said female cylindrical section having said handle section at a distal end and a port for receiving said male cylindrical section at a proximate end;

said male cylindrical section carrying said club head at a distal end and a proximate end inserted into said port of said female cylindrical section;

wherein when said first and second cylindrical sections are disposed in a fully extended position, said proximate end of said first female cylindrical section engages said proximate end of said second male cylindrical section to provide a friction lock therebetween; and wherein when said first and second cylindrical sections are disposed in a fully collapsed position said proximate end of said female cylindrical section is spaced apart from 2 to 6 inches from said club head hozel to prevent pinch of at least a portion of a player's hand when grasped about said male cylindrical section.

2. The improved golf club as defined in claim 1 wherein said improvement further comprises:

providing a rigid projection composed of steel carbide at the distal end of said handle section, said rigid projection having sufficient hardness and sufficient height to withstand impact of said handle section against a relatively hard surface, and to protect said grip member from abrasion during impact.

3. The improved golf club as defined in claim 2 wherein said rigid projection is fabricated from steel carbide.

4. The improved golf club as defined in claim 2 wherein said rigid projection extends from about $\frac{1}{8}$ inch to about $\frac{1}{2}$ inch above the distal end of said handle section.

5. The improved golf club as defined in claim 2 wherein said rigid projection is fabricated from steel carbide and imbedded within an aluminum plug provided on the distal end of said handle element.

* * * * *